United States Patent [19]

Twellmann

[11] Patent Number: 4,783,130

[45] Date of Patent: Nov. 8, 1988

[54] CIRCULAR SHAPED COMPARTMENT FLOOR FOR FURNITURE

[75] Inventor: Guenter Twellmann, Spenge-Lenzinghausen, Fed. Rep. of Germany

[73] Assignee: Ninkaplast GmbH, Bad Salzuflen, Fed. Rep. of Germany

[21] Appl. No.: 843,749

[22] Filed: Mar. 25, 1986

[30] Foreign Application Priority Data

Mar. 27, 1985 [DE] Fed. Rep. of Germany ... 8509199[U]

[51] Int. Cl.[4] ..... A47B 57/58

[52] U.S. Cl. ..... 312/193; 108/61; 211/184; 312/125; 312/135; 312/305

[58] Field of Search ..... 312/11, 97.1, 135, 193, 312/234.4, 238, 252, 305, 125; 211/184, 53, 144; 108/60, 61

[56] References Cited

U.S. PATENT DOCUMENTS

| | | | |
|---|---|---|---|
| 679,054 | 7/1901 | Kraushaar | 211/184 |
| 1,473,064 | 11/1923 | Vance | 211/184 X |
| 1,675,269 | 6/1928 | Hine | 211/184 X |
| 1,686,291 | 10/1928 | Moore | 211/184 X |
| 1,810,817 | 6/1931 | Brainard et al. | 211/184 X |
| 2,118,444 | 5/1938 | Mueller | 211/184 X |
| 2,198,459 | 4/1940 | Potts | 211/184 X |
| 2,251,740 | 8/1941 | Konikoff | 211/184 X |
| 2,309,896 | 2/1943 | Gustafson et al. | 211/184 X |
| 2,457,875 | 1/1949 | Day | 211/184 X |
| 3,221,890 | 12/1965 | Wassell | 211/184 X |
| 3,868,156 | 2/1975 | Ley . | |
| 4,453,326 | 6/1984 | Hoffman et al. . | |

FOREIGN PATENT DOCUMENTS

| | | | |
|---|---|---|---|
| 353439 | 11/1979 | Austria . | |
| 1191080 | 4/1965 | Fed. Rep. of Germany . | |
| 2061648 | 7/1971 | Fed. Rep. of Germany . | |
| 2333921 | 1/1974 | Fed. Rep. of Germany . | |
| 7411119 | 3/1974 | Fed. Rep. of Germany . | |
| 2357515 | 5/1975 | Fed. Rep. of Germany . | |
| 2511998 | 1/1977 | Fed. Rep. of Germany . | |
| 7838635 | 4/1979 | Fed. Rep. of Germany . | |
| 8125065 | 10/1981 | Fed. Rep. of Germany . | |
| 3049114 | 7/1982 | Fed. Rep. of Germany . | |
| 3211859 | 10/1983 | Fed. Rep. of Germany . | |
| 3344674 | 6/1985 | Fed. Rep. of Germany . | |
| 1424822 | 3/1966 | France . | |
| 844324 | 8/1960 | United Kingdom | 211/184 |
| 1081023 | 8/1967 | United Kingdom . | |

*Primary Examiner*—Peter A. Aschenbrenner
*Assistant Examiner*—Thomas A. Rendos
*Attorney, Agent, or Firm*—Foley & Lardner, Schwartz, Jeffery, Schwaab, Mack, Blumenthal & Evans

[57] ABSTRACT

A rotatable compartment floor (10) for corner cupboards or the like has a circular contour or a contour in the form of a circular sector and is provided at the circle center with a hub (12) and at the outer edge with a peripheral wall (14) projecting vertically upwards. To divide the surface of the compartment floor into several compartments, there is at least one radial wall element (20) which at its outer end (32) is supported on the peripheral wall (14) and at its inner end has an end piece (24) in the form of a circular arc which surrounds the hub (12) and which engages in a continuous groove (28) in the hub by means of a flange (26) projecting horizontally inwards.

16 Claims, 6 Drawing Sheets

Fig.10
Fig.10A
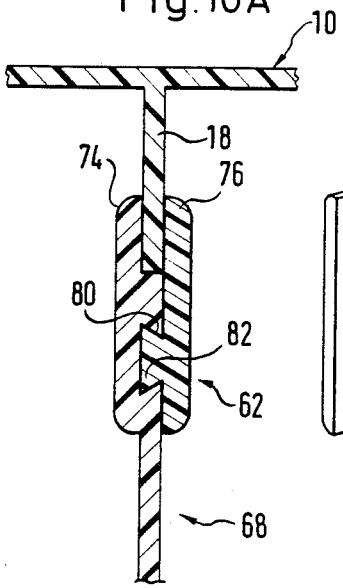
Fig.10B
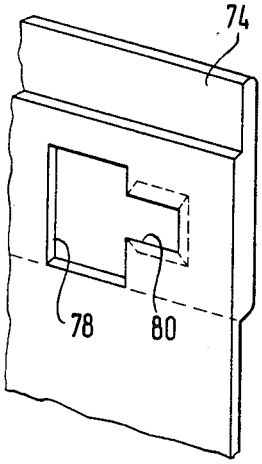
Fig.10C
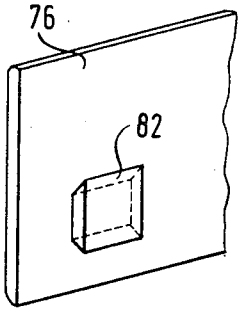
Fig.11
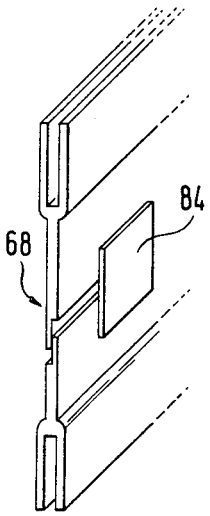
Fig.12
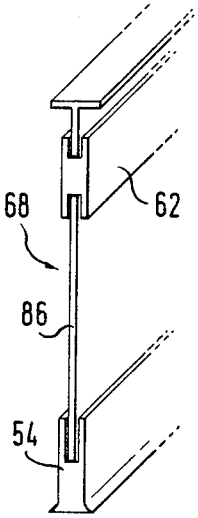
Fig.13
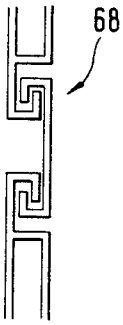
Fig.14
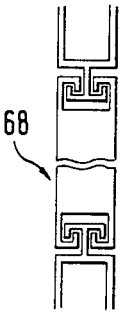

Fig.15
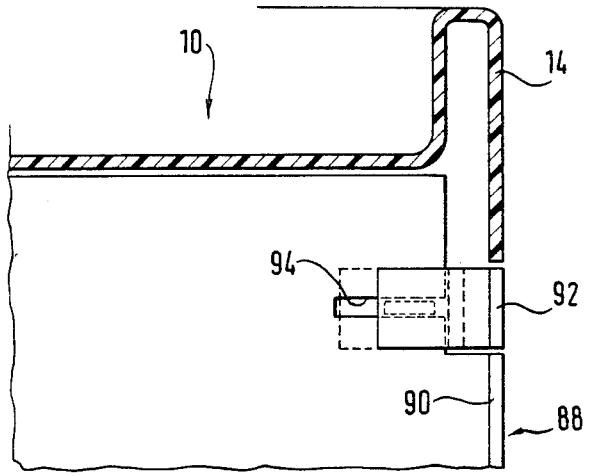
Fig.16
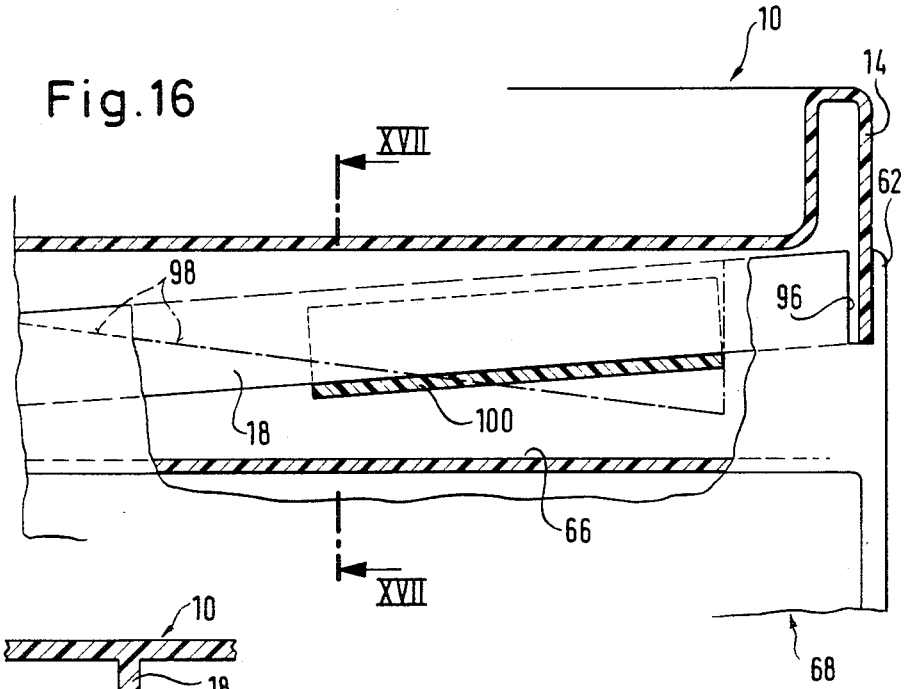
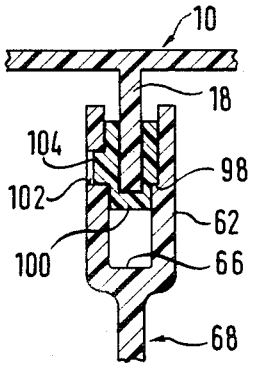
Fig.17

CIRCULAR SHAPED COMPARTMENT FLOOR FOR FURNITURE

The invention relates to a compartment floor of circular contour or of a contour in the form of a circular sector, which has at the circle center a hub and at the outer edge a peripheral wall projecting vertically upwards, and to a turntable floor insert formed from several compartment floors of this type.

Compartment floors of the type mentioned above and turntable floor inserts formed from them are arranged, above all, in the inner corners of cupboards, for example fitted kitchen cupboards, and serve for the storage of pots and other kitchen utensils. The compartment floors are rotatable about a vertical axle extending through the hub, so that the stored articles can be moved towards the open side of the cupboard by rotating the compartment floor. In this way, it becomes possible to utilize effectively the cupboard space in the inner corners which is otherwise accessible only with difficulty.

It is often desirable to divide the base of the compartment floor by partition walls, so that it becomes easier to accommodate the kitchen utensils in an orderly manner.

The object on which the invention is based is to equip the compartment floor or the turntable floor insert with partition walls which can be fastened to the compartment floor in a simple way in a position which meets the particular need.

In a compartment floor of the type mentioned in the introduction, this object is achieved by means of at least one radial wall element which is supported at its outer end on the peripheral wall and which has at its inner end an end piece in the form of a circular arc which surrounds the hub and which engages into a continuous groove in the hub by means of a flange projecting horizontally inwards.

The wall element can be clamped in any angular positions between the hub and the peripheral wall of the compartment floor, without the need to have on the base of the compartment floor or on the peripheral wall fastening devices which are detrimental to the appearance of the compartment floor and which make cleaning more difficult. The wall element is secured in the vertical direction at its inner end by means of the flange which engages in the groove of the hub. At its outer end, the wall element is held in position by the inward-directed clamping force of the peripheral wall. When the outer end of the wall element is pulled upwards, the wall element is pivoted about the inner end and canted against the peripheral wall. Consequently, the outer end of the wall element can only be lifted over the top edge of the peripheral wall by exerting a certain amount of force.

Preferably, the wall element is provided, at its outer end, with a projection resting on the top edge of the peripheral wall and with a clip which surrounds the peripheral wall from outside, grasps the bottom edge of the compartment floor and tensions the projection of the wall element against the top edge of the peripheral wall.

The compartment floor has at least one recess in the form of a circular sector, corresponding to the inner corner of the front face of the cupboard. In this case, the wall elements can also be used to close off the compartment floor at the radially extending edges of the recess.

If the compartment floor is provided with only a single radial wall element, the end piece preferably forms a 180° arc, so that the ends of the end piece which are located opposite one another can exert a certain clamping force on the hub. If desired, however, the end piece can also be designed as a shorter segment of a circular arc, so that a larger number of wall elements can be arranged on the same hub.

On a turntable floor insert consisting of several compartment floors of the type mentioned in the introduction, which are arranged on a common axle, according to the invention, the wall element is supported on the lower compartment floor and held by means of its edge against the upper compartment floor positively or non-positively.

In this way, on the one hand it becomes possible to fasten the wall element in any angular position in a simple way, and on the other hand the upper compartment floor is supported by the wall element or by several wall elements arranged in this way, so that higher loads can be carried and the turntable floor insert reinforced as a whole.

The lower region of the wall element is preferably fixed in the above-described way between the hub and the peripheral wall of the lower compartment floor, but can also be supported directly on the base of the lower compartment floor. If desired, the bottom edge of the wall element can engage in grooves in the base of the lower compartment floor or in its peripheral wall or can be prevented from shifting in the peripheral direction of the compartment floor by means of projections, resilient tongues or the like.

The top edge of the wall element can be supported directly below the underside of the base of the upper compartment floor. In this case, the wall element has at the top edge, in particular in the radially outer region, a widened upper surface which rests against the underside of the upper compartment floor, so that the wall element is prevented from tilting.

The compartment floor is often provided on its underside with radial stiffening ribs. In this case, the wall element is preferably provided along the top edge with a groove which surrounds the bottom edge of one of the stiffening ribs in the manner of a fork. When the wall element is to be released or fitted in another angular position, the upper compartment floor is loosened on the axle and raised slightly, so that the stiffening rib comes out of the groove of the wall element. If desired, the engagement between the groove of the wall element and the stiffening rib of the compartment floor can also have a certain play, so that the engagement of the wall element with the upper compartment floor can be released by bending the wall element elastically and/or rotating it about a horizontal axis, without the upper compartment floor having to be raised. Finally, it is also possible to provide the wall element in the region of the top edge with bolts, cams or the like which engage releasably with the stiffening ribs of the upper compartment floor.

Preferred exemplary embodiments of the invention are explained in detail below with reference to the drawings.

FIGS. 10 (A), (B) and (C) illustrate the releasable fastening of a wall element to a rib of a compartment floor;

FIGS. 11 to 14 show differing cross-sections of multipart wall elements;

FIG. 15 illustrates another method of fastening a wall element releasably to a compartment floor;

FIG. 16 shows a wall element with a device for adapting it to different heights of the upper compartment floor; and FIG. 17 is a section along the line XVII-XVII of FIG. 16.

Figure 1:
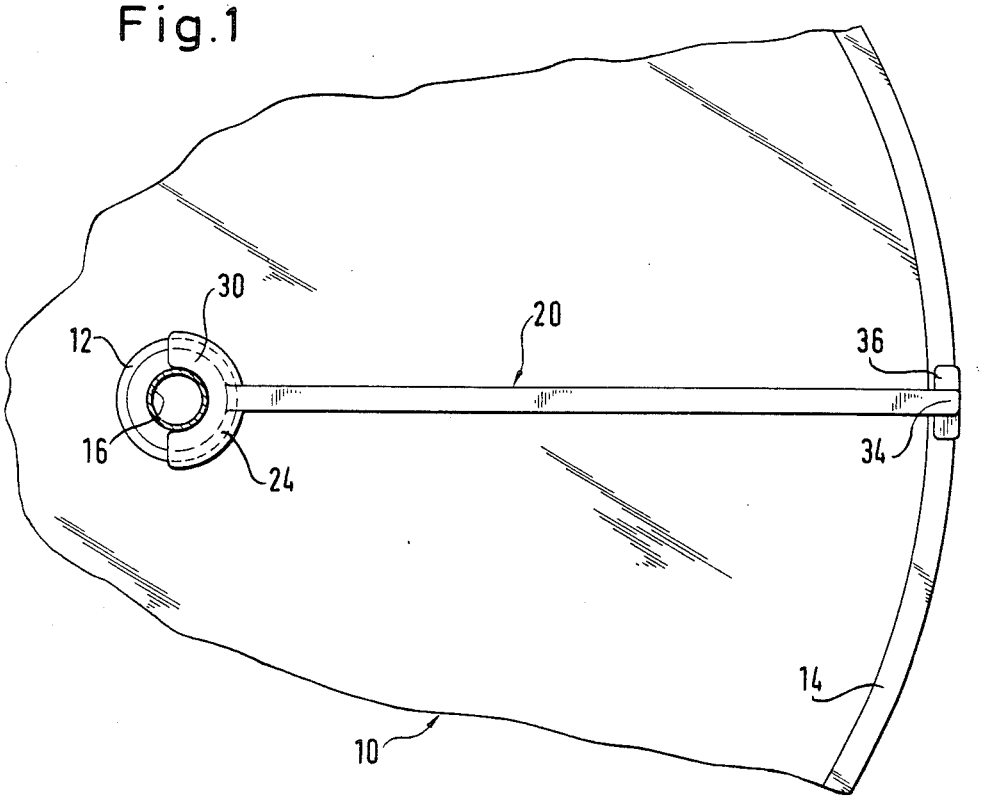
FIG. 1 shows a cut-out of a circular compartment floor with a wall element.
Figure 2:
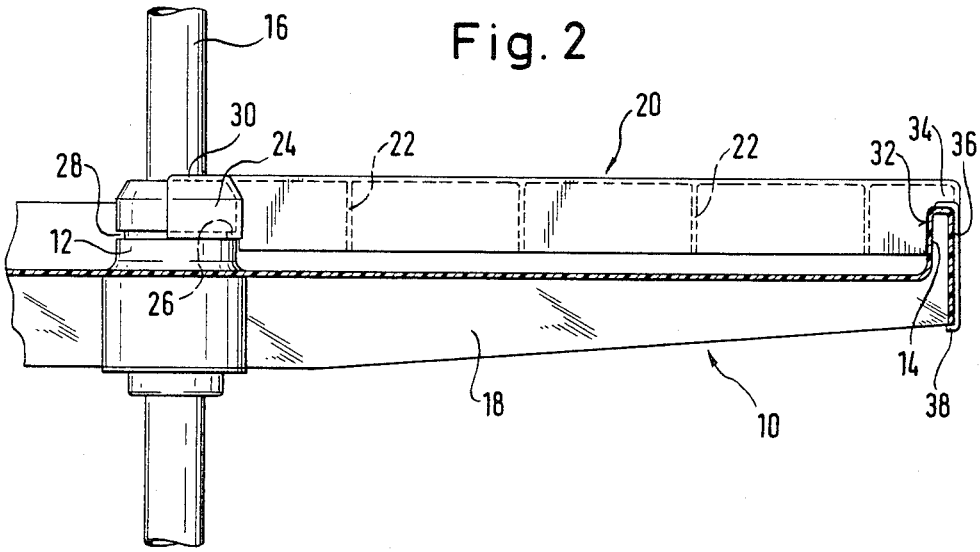
FIG. 2 shows a section through the compartment floor along a line parallel to the wall element.

Firstly, a first exemplary embodiment of the invention will be explained with reference to FIGS. 1 and 2.

A compartment floor 10 made of plastic has a hub 12 projecting upwards beyond the plane of the compartment floor and, at its outer edge extending concentrically relative to the hub 12, a low peripheral wall 14 rising vertically. The compartment floor is fastened rotatably to a vertical axle 16 by means of its hub 12. On its underside, the compartment floor 10 is provided with radial stiffening ribs 18.

A radial wall element 20 is clamped between the hub 12 and the peripheral wall 14 at a short distance from the surface of the compartment floor 10. The wall element 20 has a cross-section opened downwards in the form of a U and is provided at longitudinal intervals with vertical stiffening ribs 22. The wall element 20, likewise made of plastic, thus has a relatively high bending strength. The height of the wall element is approximately one tenth of the length.

Formed integrally on the inner end of the wall element is an end piece 24 which is in the shape of a 180° segment of a circular arc and which surrounds the periphery of the hub 12. Formed on the bottom edge of the end piece 24 is a flange 26 which projects radially inwards and which engages in a continuous groove 28 in the hub 12. The hub 12 is beveled at its top outer edge, and the inner surface of the end piece 24 matches the peripheral surface of the hub 12. The end piece 24 is provided at the top edge with a flange 30 which projects radially inwards and which rests on the upper end face of the hub 12.

At the outer end, the wall element 20 rests flush against the peripheral wall 14 by means of a vertical end face 32 which extends approximately over the lower half of the wall element. The upper half of the wall element forms a projection 34 resting on the top edge of the peripheral wall 14. A clip 36 connected integrally to the projection 34 and widened in the peripheral direction rests against the top edge and against an outer material layer of the peripheral wall 14 and engages under the bottom edge of the peripheral wall 14 by means of a bottom end 38 angled inwards in the form of a hook. In this way, the wall element 20 is secured positively against lifting, against radial displacement and against tilting about its longitudinal axis. Furthermore, the wall element is secured non-positively against rotation about the axle 16.

The wall element 20 is released from the compartment floor 10 in the following way. The bottom end 38 of the clip 36 is first bent elastically outwards, and the outer end of the wall element 20 is lifted over the top edge of the peripheral wall 14, the wall element and the peripheral wall 14 at the same time undergoing slight elastic deformation. Subsequently, the wall element is pulled radially outwards, so that the flange 26 comes out of the groove 28 in the hub. The wall element is fitted by carrying out the above-described operation in reverse order.

The wall element can thus be fastened securely to the compartment floor 10 in any angular position, without the need for special retaining devices on the surface of the compartment floor or on its peripheral wall.

If, for example when the compartment floor 10 is rotated, the articles stored on the compartment floor press against the wall element 20 in the peripheral direction, the wall element bends slightly. Since the U-profile of the wall element has a certain width, in this case the wall element is canted against the inner surface of the peripheral wall 14. In this way, the wall element is secured reliably against rotation about the axle 16.

Figure 3:
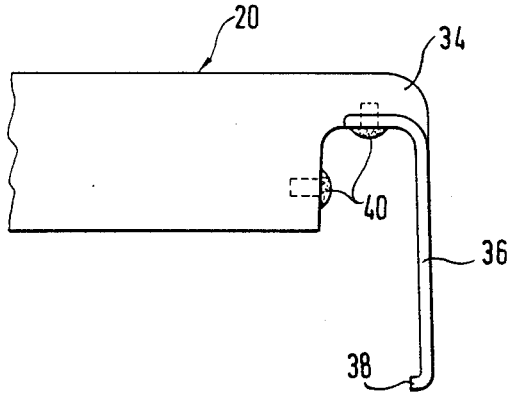
FIG. 3 shows a radially outer end of a wall element according to another exemplary embodiment of the invention.

To increase the non-positive connection between the wall element 20 and the peripheral wall 14, plugs 40 made of soft-elastic material can be arranged in the regions of the wall element which rest against the peripheral wall 14, as shown in FIG. 3.

Figure 4:
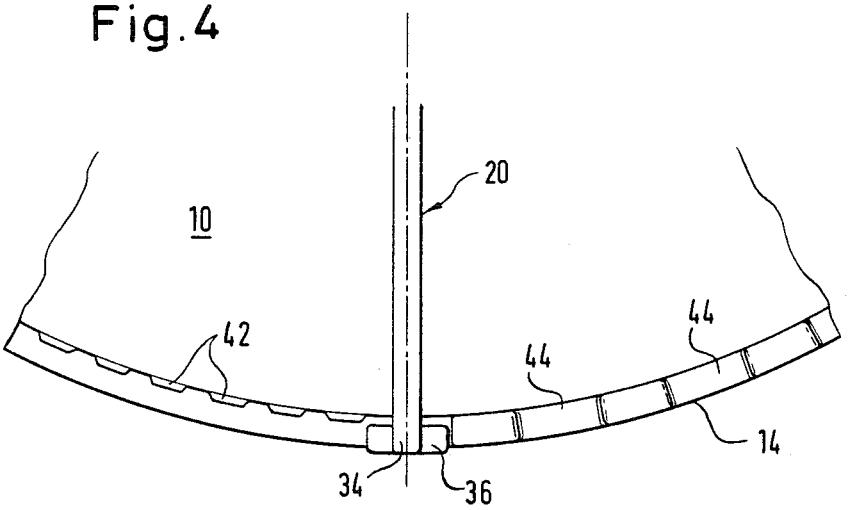
FIG. 4 shows a plan view of a peripheral portion of a compartment floor and illustrates further exemplary embodiments of the invention.

FIG. 4 shows exemplary embodiments of compartment floors 10, in which the peripheral wall 14 is profiled in such a way that the wall element 20 is secured positively against shifting in the peripheral direction.

In the left-hand half of FIG. 4, the peripheral wall 14 of the compartment floor 10 is provided on the inner face with recesses or grooves 42, in which the end of the wall element 20 engages. In the right-hand part of FIG. 4, shallow recesses 44 for the projection 34 and the top end of the clip 36 of the wall element are formed in the top edge of the peripheral wall 14.

Figure 5:
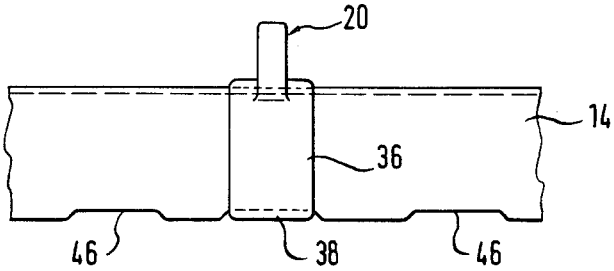
FIG. 5 is a view of the outer edge of a compartment floor with a wall element, according to a further exemplary embodiment of the invention.

According to FIG. 5, shallow recesses 46, in which the bottom end 38 of the clip 36 engages, are formed in the bottom edge of the peripheral wall 14.

The recesses 42 and 44 or 46 allow finely graded angular adjustment of the wall element 20 and also produce a decorative effect which has a beneficial influence on the appearance of the compartment floor.

Figure 6:
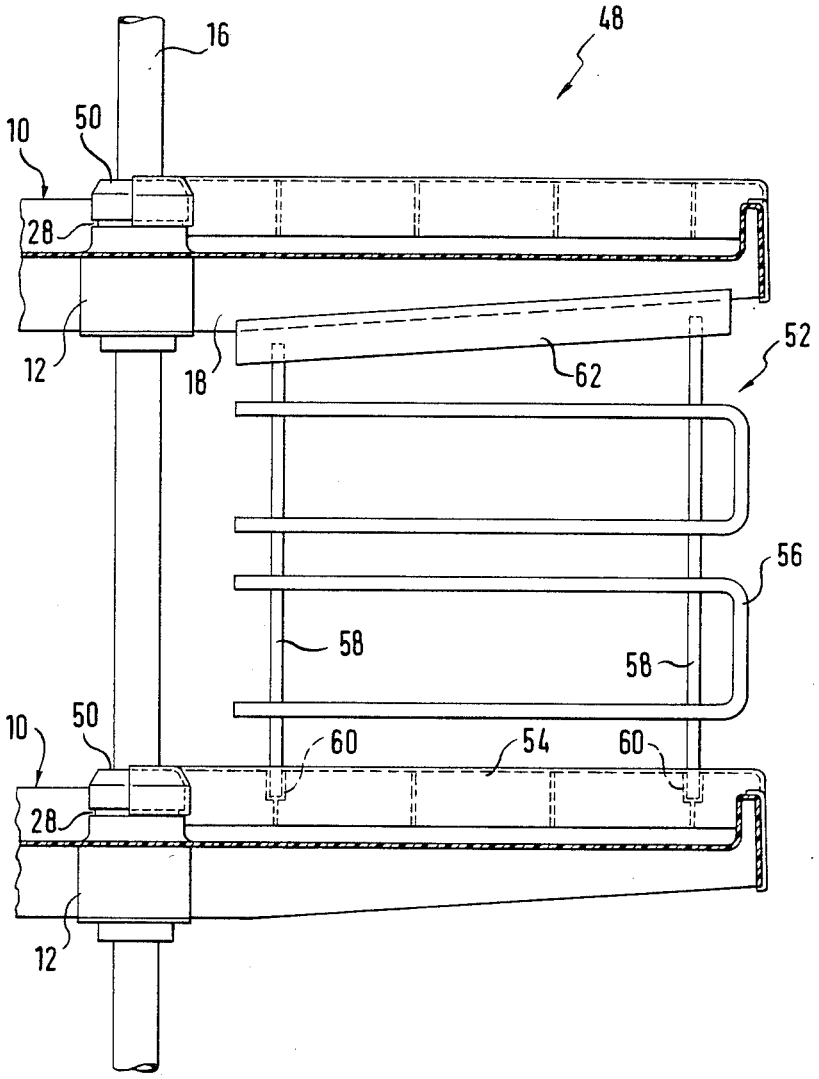
FIG. 6 is a part section through a compartment floor insert according to the invention.

FIG. 6 shows an exemplary embodiment of a turntable floor insert 48 according to the invention. The turntable floor insert is formed by two compartment floors 10 which are mounted fixedly in terms of rotation on the same axle 16. The axle 16 is mounted rotatably in a corner cupboard at its top and bottom ends (not shown). The hubs 12 of the compartment floors are each fastened to the axle 16 by means of a clamping bush 50. A relatively wide gap between the clamping bush 50 and the actual hub 12 forms a continuous groove 28.

The turntable floor insert 48 has a number of wall elements 52 which are each supported on the lower compartment floor 10 and which are held positively on one of the stiffening ribs 18 of the upper compartment floor 10. The wall element 52 has a foot 54 which in its construction and method of fastening corresponds to the wall element 20 described with reference to FIGS. 1 to 5. Fastened to the foot 54 is a wire lattice 56, the vertical bars 58 of which engage by means of their bottom ends in blind holes 60 in the foot 54. A connecting strip 62 is attached to the top ends of the vertical bars 58. The connecting strip 62 has in its top edge a groove which surrounds the bottom edge of the stiffening rib 18 in the manner of a fork.

When the wall element 52 is to be released, the clamping bush 50 of the upper compartment floor is loosened, and the upper compartment floor is lifted slightly.

The stiffening ribs 18 of the compartment floors are arranged at angular distances of 25° from one another. The angular position of the wall elements 52 can therefore be varied in a 25° grid pattern, so that the size of the compartments divided off by the wall elements 52 can be matched to the particular requirement.

Figure 7:
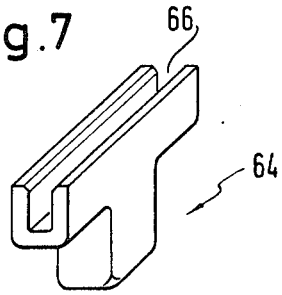
FIG. 7 is a perspective view of a connecting piece for a wall element formed by a wire lattice.

Instead of the continuous connecting strip 62, individual connecting pieces can also be arranged on the top ends of the vertical bars 58. FIG. 7 shows a connecting piece 64 of this type, which has a T-shaped form and which is provided at the top edge with a groove 66 for receiving the bottom edge of the stiffening rib 18.

Figure 8:
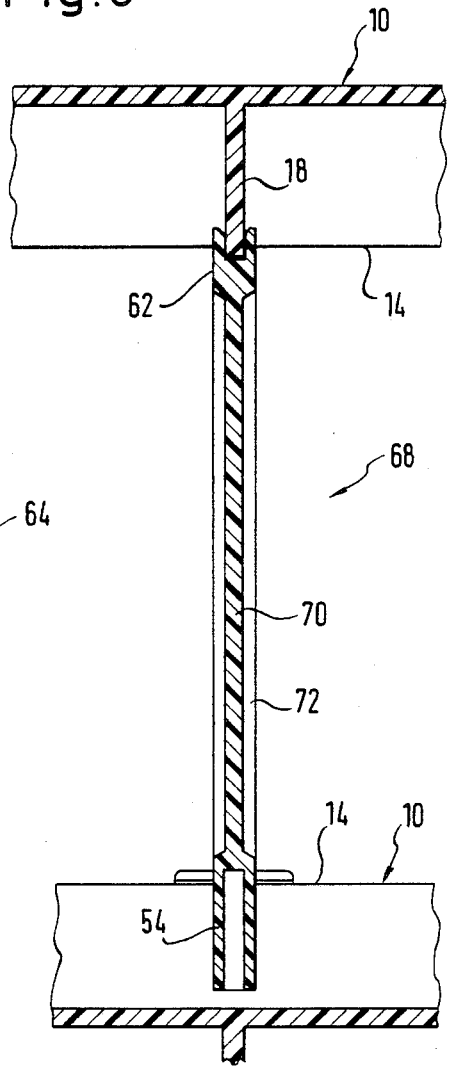
FIG. 8 is a vertical section through two compartment floors and a wall element according to another exemplary embodiment of the invention.

FIG. 8 shows a further exemplary embodiment of a wall element 68. This wall element is a one-piece plastic part which has a foot 54 and a connecting strip 62 in a similar way to the wall elements 52, but in which there is a continuous wall 70 instead of the wire lattice. At the radially outer end of the wall element 68, the wall 70 is closed off by means of a thickened edge 72.

Figure 9:
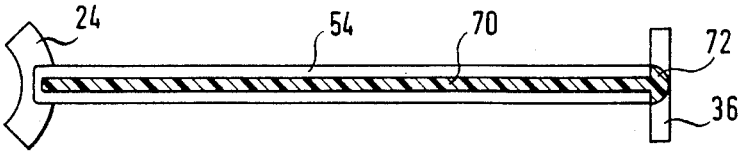
FIG. 9 is a horizontal section through the wall element according to FIG. 8.

As can be seen in FIG. 9, in this case the circularly arcuate end piece of the foot 54 forms a 90° arc, so that a maximum of four wall elements 68 can be arranged between the compartment floors 10. If a larger number of wall elements or a certain allowance for changing the compartment division is desired, the arc of the end piece 24 can be further reduced.

Instead of the connecting strip 62 of the wall elements 52 and 68, there can be releasable bolts which make it possible to disconnect the wall element and the stiffening rib 18 from one another, without the upper compartment floor having to be raised. It is possible, furthermore, to provide the upper compartment floor 10 on the underside or on the inner face of the peripheral wall 14 with grooves, into which the top edge of the wall element or a connecting piece of the wall element can be pushed. Finally, it is also possible to secure the wall element non-positively to the upper compartment floor 10. For this purpose, lips made of soft-elastic plastic or plugs similar to the plugs 40 in FIG. 3 can be provided at the top edge of the wall element.

FIG. 10 illustrates a possibility for fastening the wall element 68 releasably to the stiffening rib 18 of the upper compartment floor. As can be seen in the section in FIG. 10A, in this case the connecting strip 62 consists of two parts 74, 76 which are shown in perspective in FIGS. 10B and 10C. The part 74 is connected rigidly to the center point of the wall element 68 and has a recess 78 communicating with a dovetail groove 80. The part 76 is provided with a corresponding dovetail 82. When the connecting strip 62 is to be fastened to the stiffening rib 18, the dovetail 82 is inserted into the recess 78 and pushed into the dovetail groove 80, so that the two parts 74, 76 are connected positively to one another and surround the bottom edge of the stiffening rib 18.

According to FIG. 11, the wall element 68 as a whole is made in two parts, and the two parts are held together by means of slides 84 which are engaged with the two parts of the wall element via dovetail guides (not shown) converging in a wedge-shaped manner. In this embodiment, the height of the wall element 68 can be varied infinitely by shifting the slides 84 in the longitudinal direction of the wall element, that is to say in the radial direction of the compartment floor.

FIG. 12 shows a further embodiment of the wall element 68, in which a plastic panel 86 is pushed into grooves in the foot 54 and in the connecting strip 62. The wall element 68 according to FIG. 12 can likewise be fitted without the upper compartment floor 10 having to be raised, by pushing the panel 86 radially into the grooves in the foot and in the connecting strip. If the top and bottom edges of the panel 86 converge in a wedge-shaped manner in the direction of the axle 16, as a result of the insertion of the panel 86 the wall element 68 can be braced in a self-locking manner between the lower compartment floor and the stiffening rib or base of the upper compartment floor.

In a wall element consisting of several partially wedge-shaped parts, the individual parts can also be engaged with one another by means of dovetail guides or similar guide profiles. Examples of suitable guide profiles are illustrated in FIGS. 13 and 14.

FIG. 15 shows a further exemplary embodiment of the invention, in which a wall element 88 is supported directly under the face of the upper compartment floor 10 by means of a widened front edge 90. A bolt 92 is arranged in the extension of the edge 90 and is guided displaceably in a slot 94 of the wall element. The bolt 92 can be locked in the position represented by unbroken lines in FIG. 15 and is located virtually free of play under the bottom edge of the periphal wall 14 of the upper compartment floor. In this position, the bolt 92 prevents the wall element 88 from tilting about its bottom edge, since the bolt is canted against the peripheral wall 14. To release the wall element, the bolt 92 is shifted in the groove 94 into the position represented by broken lines. When the bolt is in this position, there is sufficient play between the front edge 90 of the wall element and the bottom edge of the peripheral wall 14, for the wall element 88 to be able to be tilted and extracted from the interspace between the compartment floors.

Even where the wall element 52 shown in FIG. 6 is concerned, it can become possible to release the wall element without raising the upper compartment floor 10. This can be achieved, for example, by supporting the connecting strip 62 or the connecting pieces 64 elastically on the wire lattice by means of helical compression springs.

FIGS. 16 and 17 show a modified exemplary embodiment of the wall element 68 according to FIG. 8. The connecting strip 62 of this wall element has a very deep and wide groove 66 which overlaps the stiffening rib 18 of the upper compartment floor 10 to a relatively great extent. The wall element 68 also has, at the outer edge, a vertical slot 96 which receives the bottom edge of the peripheral wall 14 of the compartment floor. These measures ensure that, even when there are certain differences in the height of the upper compartment floor 10 relative to the lower compartment floor, a neat connection of the wall element is always guaranteed. The groove 66 is provided with sloping shoulders 98 on its side walls. Supported on the shoulders 98 is a clamping piece 100 which surrounds the bottom edge of the stiffening rib 18 in the manner of a fork. The connecting strip 62 has a lateral slot 102, in which a projection 104 of the clamping piece engages. By means of a screwdriver inserted into the slot 102, the clamping piece 100 can be adjusted in the direction of the sloping shoulders 98, in such a way that the stiffening rib 18 of the upper compartment floor is supported securely on the wall element 68 via the clamping piece 100.

In the embodiment according to FIG. 6, by an appropriate adjustment of the length of the vertical bars of the wire lattice it is possible to match different heights of the upper compartment floor. According to the inventor's knowledge acquired hitherto, the embodiment according to FIG. 6 is a particularly advantageous embodiment of the invention.

Alternatively, however, wire hoops of another shape, which are not connected to the upper compartment floor, can also be inserted into the blind holes of the foot 54 according to FIG. 6. Moreover, it is possible to insert into the outer blind holes 60 of two wall elements arranged on the same compartment floor a wire hoop which extends above the peripheral wall 14 in the peripheral direction of the compartment floor, so that the effective height of the peripheral wall is increased without any changes to the compartment floor itself.

I claim:

1. A turntable floor insert comprising a compartment floor of circular contour or of a contour in the form of a circular sector, which has at the circle center, a hub and at the outer edge, a peripheral wall projecting vertically upwardly, wherein there is at least one radial wall element which is supported at its outer end on the peripheral wall and which has at its inner end an end piece in the form of a circular arc which surrounds the hub and which engages in a continuous circumferential groove in the hub with a circumferential bottom flange projecting radially inwardly, so that the radial wall element is clamped between the hub and the peripheral wall, the radial wall element and the peripheral wall being of an elastically deformable construction to permit insertion and removal of said radial wall element.

2. A turntable floor insert as claimed in claim 1, wherein the end piece forms a 180° arc.

3. A turntable floor insert as claimed in claim 1, wherein the wall element has, at the outer end, a projection resting on the top edge of the peripheral wall.

4. A turntable floor insert as claimed in claim 3, wherein the projection is provided with a clip surrounding the bottom edge of the peripheral wall.

5. A turntable floor insert as claimed in claim 4, wherein the clip is widened in the peripheral direction.

6. A turntable floor insert as claimed in claim 1, wherein the end piece has, at the top edge, a flange resting on the upper end face of the hub.

7. A turntable floor insert as claimed in claim 1, wherein the wall element has a cross-section opened downwards in the form of a U.

8. A turntable floor insert as claimed in claim 1, wherein the wall element, in the surface regions engaging with the peripheral wall of the compartment floor, is provided with plugs made of soft-elastic material, to increase the static friction between the wall element and the peripheral wall.

9. A turntable floor insert as claimed in claim 1, wherein the peripheral wall is provided at regular intervals in the peripheral direction with recesses for receiving part of the wall element.

10. A turntable floor insert as claimed in claim 1, which comprises at least two compartment floors which are circular or in the form of a circular section, which each have at the circle center a hub and at the outer edge a peripheral wall projecting upwards and which are fastened by means of their hubs on a rotatable axle at a distance from one another, and wherein there is at least one radial wall element which is supported by one of said compartment floors and which is positively or non positively held on the upper of said compartment floor by means of its top edge.

11. A turntable floor insert as claimed in claim 10, wherein the wall element (88) has, at the top edge, a plane face which rests flat against the underside of the upper compartment floor.

12. A turntable floor insert as claimed in claim 10, wherein the wall element has, in its top edge, a longitudinally extending groove, which engages the bottom edge of a stiffening rib extending radially on the underside of the upper compartment floor.

13. A turntable floor insert as claimed in claim 12, wherein the wall element comprises has a plastic foot, a wire lattice inserted into blind holes in the foot, and at least one connecting piece attached to the top end of the wire lattice.

14. A turntable floor insert as claimed in claim 12, wherein the wall element is formed by a one-piece plastic part.

15. A turntable floor insert as claimed in claim 10, claims 11 to 16, wherein the wall element consists of several parts and is adjustable in height by shifting these parts relative to one another.

16. The turntable floor insert as claimed in claim 1, wherein the radial wall element between the outer end and said inner end is free of connections to said compartment floor.

* * * * *